US007260902B2

(12) United States Patent
Curtis

(10) Patent No.: US 7,260,902 B2
(45) Date of Patent: Aug. 28, 2007

(54) JACK FOR A WORKING IMPLEMENT AND METHOD

(75) Inventor: Marc D. Curtis, Spencer, MA (US)

(73) Assignee: Curtis Industries LLC, Worcester, MA (US)

( * ) Notice: Subject to any disclaimer, the term of this patent is extended or adjusted under 35 U.S.C. 154(b) by 312 days.

(21) Appl. No.: 10/992,535

(22) Filed: Nov. 18, 2004

(65) Prior Publication Data

US 2005/0066552 A1 Mar. 31, 2005

Related U.S. Application Data

(62) Division of application No. 10/368,963, filed on Feb. 19, 2003, now Pat. No. 7,103,995.

(60) Provisional application No. 60/434,556, filed on Dec. 18, 2002, provisional application No. 60/412,347, filed on Sep. 20, 2002.

(51) Int. Cl.
*E02D 17/06* (2006.01)
*E02F 5/18* (2006.01)

(52) U.S. Cl. ..... 37/370; 37/231; 254/419; 172/273

(58) Field of Classification Search ..... 37/231, 37/235, 236, 270, 266, 271; 172/810, 817, 172/272, 273; 254/418, 419, 420, 422, 423
See application file for complete search history.

(56) References Cited

U.S. PATENT DOCUMENTS

| | | | | |
|---|---|---|---|---|
| 2,143,182 A | | 1/1939 | Barr | 280/761 |
| 2,222,116 A | | 11/1940 | Mott | 37/2.2 |
| 2,322,358 A | | 6/1943 | Hansen | 254/86 |
| 2,555,925 A | | 6/1951 | Genthe | 254/86 |
| 3,160,965 A | | 12/1964 | Walker et al. | 37/232 |
| 3,236,501 A | | 2/1966 | McKay | 254/419 |
| 3,362,683 A | | 1/1968 | Hansen | 254/423 |
| 3,801,068 A | | 4/1974 | Kopas | 254/86 R |
| 3,844,582 A | | 10/1974 | Cook | 280/764.1 |
| 3,860,216 A | | 1/1975 | Brown | 254/423 |
| 3,874,696 A | * | 4/1975 | Gardner et al. | 254/419 |
| 3,985,036 A | | 10/1976 | Decker et al. | 74/96 |
| 4,113,274 A | * | 9/1978 | Vahrenkamp | 280/475 |
| 4,118,054 A | | 10/1978 | Vigerie | 280/765.1 |
| 4,187,624 A | | 2/1980 | Blau | 37/42 R |
| 4,205,825 A | | 6/1980 | Stanford | 254/86 R |
| 4,357,995 A | | 11/1982 | Kappenhagen | 187/17 |
| 4,439,939 A | | 4/1984 | Blau | 37/231 |
| 4,536,009 A | | 8/1985 | Ashworth | 280/755 |
| 4,574,502 A | | 3/1986 | Blau | 37/266 |
| 4,637,772 A | | 1/1987 | Stumpe | 414/686 |
| 4,711,428 A | | 12/1987 | Carpenter | 254/423 |
| 4,807,375 A | | 2/1989 | Iraci | 37/236 |
| 4,821,435 A | | 4/1989 | Pester | 37/231 |
| 5,011,184 A | | 4/1991 | Loudon | 280/766.1 |
| 5,014,452 A | | 5/1991 | Berghefer | 37/235 |
| 5,125,174 A | | 6/1992 | Watson et al. | 37/231 |

(Continued)

*Primary Examiner*—Thomas A. Beach
(74) *Attorney, Agent, or Firm*—Nields & Lemack

(57) ABSTRACT

Jack for raising and lowering a working implement such as hydraulically driven snow blades or other utilitarian accessories. Actuation of the jack allows for proper vertical alignment of the lift assembly for engagement to a vehicle chassis. Once engaged, the jack can be actuated into an inoperative position until the lift assembly is to be removed from the chassis.

10 Claims, 9 Drawing Sheets

U.S. PATENT DOCUMENTS 5,185,946 A 2/1993 Farrell ..... 37/231
5,195,261 A 3/1993 Vachon ..... 37/231
5,234,225 A 8/1993 Yaple ..... 280/293
5,353,530 A 10/1994 Pieper ..... 37/231
5,397,187 A 3/1995 Cachinero et al. ..... 384/460
5,401,046 A 3/1995 Schwartz et al. ..... 280/425.1
5,524,368 A 6/1996 Struck et al. ..... 37/235
5,540,289 A 7/1996 Hirooka et al. ..... 172/274
5,568,694 A 10/1996 Capra et al. ..... 37/231
5,743,339 A 4/1998 Alexander, III ..... 172/272
5,832,637 A 11/1998 Aguado et al. ..... 37/234
5,894,688 A 4/1999 Struck et al. ..... 37/271
6,102,131 A 8/2000 Malinowski ..... 172/273
6,145,222 A 11/2000 Curtis ..... 37/231
6,149,180 A 11/2000 Haws ..... 280/479.1
6,151,808 A 11/2000 Curtis ..... 37/234
6,209,231 B1 4/2001 Curtis ..... 37/231
6,240,659 B1 6/2001 Curtis et al.
6,354,024 B1 3/2002 Kost et al. ..... 37/231
6,381,880 B1 5/2002 Curtis ..... 37/231
6,526,677 B1 3/2003 Bloxdorf et al. ..... 37/231
6,594,923 B1 7/2003 Kost et al. ..... 37/231
6,775,933 B2 8/2004 Wendorff et al. ..... 37/231
6,874,582 B2 4/2005 Hollinrake et al. ..... 172/272

* cited by examiner

JACK FOR A WORKING IMPLEMENT AND METHOD

This application is a divisional of U.S. Ser. No. 10/368,963 filed Feb. 19, 2003, now U.S. Pat. No. 7,103,995, which claims priority of Provisional Application Ser. No. 60/412,347 filed Sep. 20, 2002 and Provisional Application Ser. No. 60/434,556 filed Dec. 18, 2002; the disclosures of which are hereby incorporated by reference.

BACKGROUND OF THE INVENTION

Conventional snow blade mounts for four wheel drive vehicles such as pick-up trucks and ATV's can weigh several hundred pounds, and generally include a chassis frame that can be permanently fixed to the vehicle chassis, usually behind the vehicle front bumper. A lift frame is then removably coupled to the chassis frame, and the snow blade is then coupled to the front end of the assembly via an A-frame and trip frame assembly. The A-frame with the snow blade attached is typically removable from the vehicle. Conventionally, the lift frame has been permanently mounted to the chassis frame (and therefore not readily removable from the vehicle), and the hydraulic pump used to operate the snow blade was located under the vehicle hood, and were driven using a belt drive driven by the vehicle engine. However, safety considerations now often dictate that the lift frame be removed when the plow is not in use.

One drawback of conventional snow blade mounts is the difficulty in readily attaching and removing the lift frame assemblies from the vehicle chassis, especially in view of their weight. To that end, U.S. Pat. No. 5,125,174 discloses a removable snowplow including a removable lift frame and A-frame combination. However, the lift frame assembly is permanently mounted to the A-frame, thus requiring removal of both simultaneously, as a unit. U.S. Pat. No. 5,353,530 is of a similar vein.

Conventional mounting systems utilize a pin arrangement, whereby the vehicle and mount assembly must be properly aligned prior to coupling the mount to the chassis with a pair of pins. This mounting and dismounting is difficult and tedious.

It is an object of the present invention to provide a snow blade hitch mount that includes a jack for lifting the assembly for proper vertical alignment with the vehicle chassis mount receiving unit.

It is a further object of the present invention to provide a jack assembly for raising and lowering a working implement.

SUMMARY OF THE INVENTION

The problems of the prior art have been overcome by the present invention, which in one embodiment provides a jack for a mount assembly for snow blades or other working implements or accessories. A plow assembly that optionally includes a lift frame is removably coupled to a mounting frame attached to the vehicle, such as the vehicle chassis. The jack enables proper positioning of the assembly relative to the vehicle or other structure for easy mounting and dismounting thereto.

DETAILED DESCRIPTION OF THE INVENTION

Figure 1:
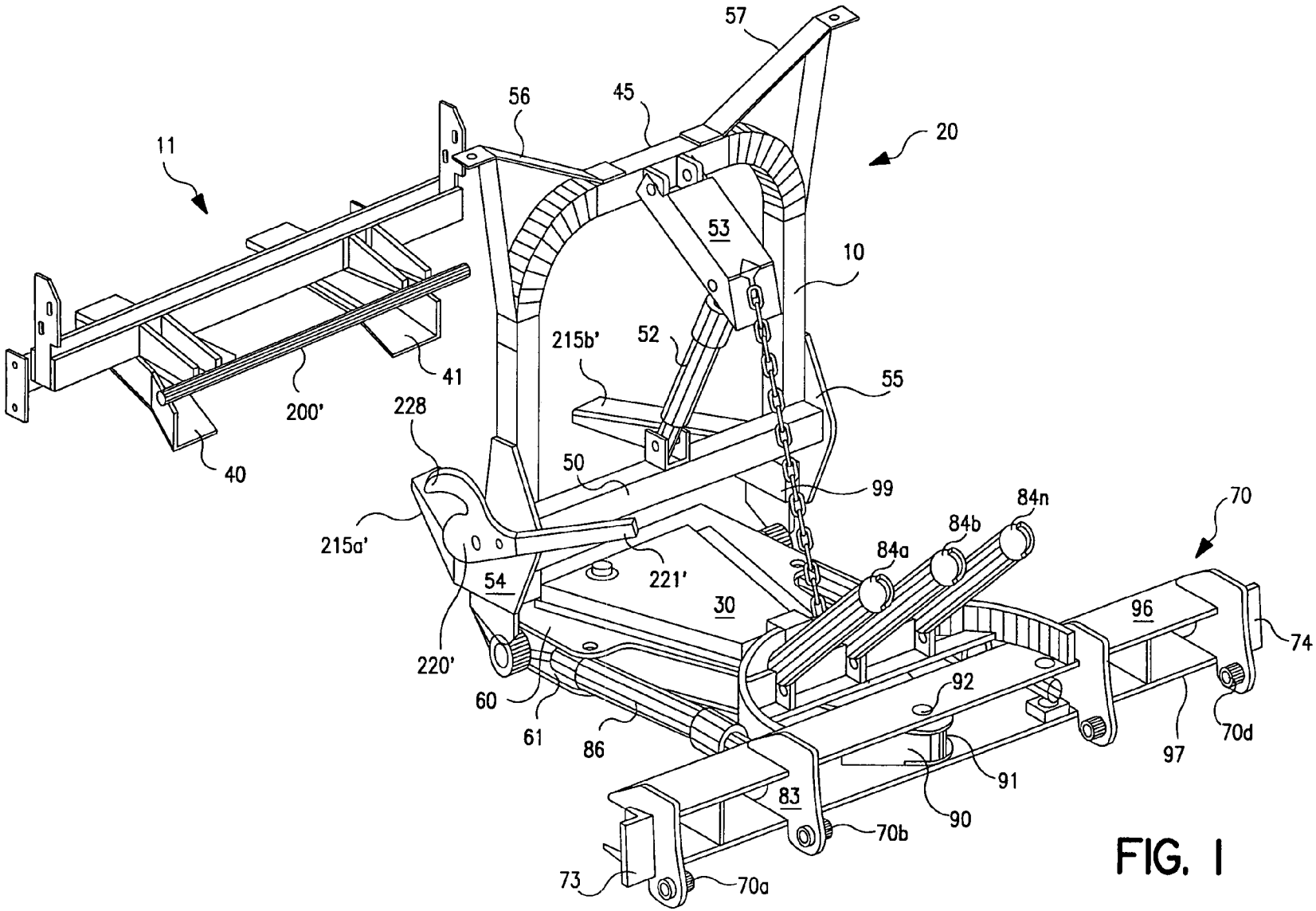
FIG. 1 is a perspective exploded view of an exemplary snow blade mounting system that can be used in accordance with the present invention.

Turning first to FIG. 1, there is shown generally at 10 a snow blade lift and hitch assembly that is suitable for use in the present invention. Those skilled in the art will appreciate that the assembly shown is for purposes of illustration, and that the invention is not limited to any particular lift and hitch assembly design. For example, although the illustrative embodiment includes the use of an A-frame, T-frames or other designs could be used. Similarly, the lift frame as shown can be optional, and other working implements can be maneuvered using the jack assembly of the present invention. Suitable vehicles include trucks, ATV's, UTV's and automobiles.

Vehicle mounted receiver frame 11 attaches to the vehicle chassis frame (not shown), preferably behind the front bumper by means of pins or bolts (not shown). Any suitable means can be used to secure the receiver 11 to the chassis, such as bolting. The actual design of the receiver 11 interface for attachment to the chassis will depend upon the identity (and thus design) of the particular vehicle or the particular vehicle chassis, and is well within the skill in the art.

The receiver 11 preferably remains permanently mounted to the vehicle, regardless of whether the snow blade or other accessories are in use. Its main purpose is to provide a means of attachment of the follow-on components, such as those that provide the lift and angle of the snow blade where the follow-on component is a snow blade, and to absorb and transfer any shock loads imposed on the snow blade (or other accessory) into the vehicle chassis.

A receiver arrangement is created for the frame 10 (which is preferably removable) and A-frame 30, preferably integral therewith, or for any other accessory to be attached to the vehicle via the receiver 11. A pair of spaced side guides 40, 41 extend vertically downward from the receiver 11, and then inward toward each other as shown. Two spaced discontinuous male portions 215*a* and 215*b* tapering towards each other extend from the frame assembly 10 as shown. Each male portion 215*a*' and 215*b*' is configured to be received by the corresponding spaced female guide members 40, 41 of the receiver 11. Alternatively, the male portions could be located on the receiver 11, and the female portions on the assembly 10.

Frame 10 and A-frame 30 assembly are adapted to be releasably coupled to the receiver 11. The following description of the frame 10 and A-frame 30 is similar to that disclosed in co-pending U.S. Ser. No. 08/640,145, the disclosure of which is incorporated herein by reference, although those skilled in the art will appreciate that the present invention is not limited to that particular frame 10 and A-frame 30 design. The frame 10 as shown has a generally rectangular shape, although the present invention is not to be so limited. A transverse vertical actuator support tube 50 is coupled to the frame 10 between side gusset plates 54, 55, and includes a central bracket 51 for attachment of one end of a vertical lifting means 52 such as a hydraulically driven actuator or cylinder. The opposite end of the vertical lifting means 52 is coupled to pivot hood 53, which in turn is pivotally mounted to the underside of top cross bar 45 of the frame 10 as shown. The pivot hood 53 has means to which one operative end of a linking means such as a chain 110 or the like can be mounted. The other operative end of the linking means is mounted by any suitable means to an angle iron coupled to the snow plow blade, so that actuation of the vertical lifting means 52 causes a corresponding vertical lift of the hood 53, which thereby lifts the snow plow blade or working implement.

Side gussets 54, 55 are shown coupled to vertical legs 46, 46' of the frame 10, such as by welding, and will be discussed in greater detail below. Triangular light mounts 56, 57 are provided on the frame 10 to support additional lighting or the like. Fixed to inside edges of the legs 46, 46' of the frame 10 are opposite right angle A-frame limit stops 98, 99 (only 99 shown) positioned to prevent the A-frame 30 from lifting too high.

A compartment in the A-frame 30 is defined by a top plate 60 and an opposite, substantially co-extensive and spaced parallel bottom plate 61. A stabilizer 36 comprising a formed C-channel is mounted on the top surface of the A-frame and mates to a stabilizer ½ ring 77 attached to the trip frame 70. The stabilizer 36 contains and stabilizes the ½ ring 77, thus stabilizing the trip frame to which the ½ ring 77 is attached. Those skilled in the art will appreciate that the stabilizer 36 can be designed having shapes other shapes than that shown, as long as it properly stabilizes the trip frame assembly 70.

Located in the body of the A-frame substantially between top and bottom surfaces 60, 61 is an actuator drive cavity. Locating the actuator drive means (preferably an electric/hydraulic pump assembly) substantially within the body of the A-frame 30 lightens the frame 10 (where the pump was conventionally located) for easy removal. Instead, the dead weight of the actuator drive means is advantageously added to the blade, assisting in creating a cleaner snowplow pass. Importantly, the actuator drive means in this location in no way obstructs the radiator of the vehicle, thereby allowing proper air flow to cool the vehicle engine and help prevent overheating. In addition, the actuator drive means is well sheltered, minimizing potential damage as the vehicle approaches the blade assembly for mounting. It also allows for shorter hydraulic lines to the angle pistons, and allows for more clearance in the basic geometry, thereby allowing higher blade motion for stacking snow. Preferably, the bulk of the actuator drive means is located substantially in the horizontal plane of the A-frame defined by the top and bottom surfaces 60, 61. Most preferably, a lower recess/skid plate coupled to the underside of plate 61 supports the pump assembly slightly below the plane of plate 61 of the A-frame 30, thereby maximizing the lift height of the A-frame 30. A removable top cover optionally having a hydraulic fluid reservoir fill cap 68 provides further protection for the pump assembly.

Trip frame assembly 70 is the preferred means for attaching the snow blade to the A-frame 30. The trip frame 70 allows the blade to pivot forward, which allows it to trip over obstacles and absorb shock that would otherwise be transferred into the plow frame assembly and vehicle, which in extreme cases would cause substantial damage. The front of the trip frame 70 is defined by a trip frame angle pivot, which comprises a top horizontal plate 96 and a spaced, parallel, co-extensive bottom horizontal plate 97. Angled plates 90, 91 receive the apex of the A-frame and provide a stop. The A-frame is pivotally mounted through axially aligned hole 92 in horizontal plates 96, 97. The trip frame angle pivot includes four horizontal axially aligned pivot bushings **70*a*-70*d* each mounted on a rib 83 intersecting horizontal top and bottom plates 96, 97. The pivot bushings 70*a*-70*d* each mate to a recess formed in the back of the plow blade. Welded at extreme opposite ends of trip frame 70 are right angle blade trip stops 73, 74**. These provide an angled stop against the vertical blade rib of blade. Were the blade allowed to trip forward all the way to the ground, it could become lodged or could spring board up very abruptly, causing damage. In addition, the lower stop keeps the spring extension within its designed operating range which prevents the springs from stretching (overstretching of the springs permanently damages the springs, making them unable to return the blade to its full upright position).

Those skilled in the art will recognize that the foregoing trip frame assembly is not required; the snow blade can articulate directly from the A-frame and by directly coupled thereto via pistons and pivots. Other trip designs could also be used.

Welded on the top cross bar 96 is the ½ ring 77 mentioned above, which stabilizes the trip assembly and pivot. A right angle cross bar 85 is positioned within the ½ ring 77, and supports a plurality of trip return springs means **84*a*-84*n* (three shown). The opposite ends of the return springs means 84** are coupled to the snow blade through an upper spring mount on the rear of the blade.

A pair of spaced horizontal actuators such as cylinders 86, 87 are each mounted at one end between top and bottom horizontal plates 96, 97. The opposite ends of each horizontal actuator 86, 87 are pivotally coupled to the A-frame at shoulders 80, 80', 81, 81' (81' not shown). These horizontal actuators 86, 87 are operatively connected to the actuator drive assembly (not shown) housed in the A-frame 30 cavity by suitable hosing.

The snow blade can be conventional in design. The preferred blade is a sheet of steel bumped or rolled to a semi-round shape and then braced on the backside with a plurality of vertical ribs and horizontal members comprised of formed stiffeners and a frog angle at the very base to absorb shock. C-shaped shoe mounts coupled to the back of the plow blade provide a surface for the blade to ride on.

The controls for operating the assembly are housed inside the cab of the vehicle for easy access to the operator. Typically, there are two separate momentary contact switches in any position but the down position, where it is not momentary. A plurality of solenoids are used to control the mechanism, such as a solenoid to control the power that runs the motor for the pump. This circuit is energized off of any of the control positions except the down position, thereby actuating the pump to raise and/or angle the blade. Gravity allows the blade to return to ground. Three hydraulic solenoids are mounted to the output manifold of the pump. One is the unit that opens the path to lift the blade, another is the unit that opens the path to lower the blade assembly. In the up position, the first solenoid opens the valve and the pump is energized, which raises the blade. In the down position, the other solenoid opens its respective valve, but the pump is not energized, which allows the blade to lower.

There is a three-position hydraulic spool valve for the angling of the blade. As the switch is pushed to one side, it opens the corresponding valve and energizes the pump, which then pumps fluid into the corresponding piston which causes the piston to extend and to thereby angle the blade. At the same time, it allows the non-pressurized piston to collapse and fluid to return to the tank (the force of the extending piston collapses the opposite piston). When the switch is engaged in the other direction, the reverse occurs. When the switch is returned to the neutral position, so does the valve.

Receiver 11, preferably made of ⅜" mild steel, is coupled to the vehicle chassis by suitable means. The front plow engaging end of the receiver 11 includes a round elongated bar or rod 200, preferably solid and at least about 1" in diameter, secured to the receiver frame by suitable means such as welding. In the embodiment shown, the bar 200 extends horizontally a distance sufficient to be engaged at or near its opposite ends by a pair of opposite latch hooks 220 discussed in detail below. However, those skilled in the art will appreciate that the bar 200 need not be continuous; two separate bars could be used at each end of the receiver frame 11, as long as they are appropriately positioned for engagement by the latch hooks 220. Receiver 11 includes generally longitudinally extending (in the direction from the vehicle front to the vehicle rear) guide members 40, 41 as discussed above, which help ensure proper alignment of the assembly 10. The spacing or volume between these guide members and the top of receiver 11 is configured to accommodate the male ends 215*a*, 215*b* of the hitch assembly coupled to the frame 10 via the side gussets 54, 55. Thus the male ends 215*a*, 215*b* are preferably tapered as shown, and can include rounded corners to facilitate hitch engagement. Stated differently, the male ends 215*a*, 215*b* are each tapered such that the length of its free engaging end is shorter than the length of its opposite end coupled to the assembly 10. Similarly, guide members 40, 41 are configured and placed such that the receiver volume is tapered, with its end farthest from the vehicle front being shorter than the end at the bar 200. The guide members 40, 41 thus act as a track for receiving and aligning male ends 215*a*, 215*b*.

Pivotally coupled to each side gusset 54, 55 via pivot shaft 219 are respective latches 220. Preferably the latches 220 share a common pivot shaft, the pivot shaft extending from one latch to the other so that movement of the two latches is coordinated; actuation of one latch results in a corresponding movement of the other latch. In this way, the movement of the latches can be controlled by a single lever 221 coupled to one of the latches 220. Alternatively, separate pivot pins could be used for each latch 220, with each latch having separate means for actuation.

Each latch 200 has a hook shape including an arcuate recess 225 corresponding in angle to the circumference of the bar 200, that creates a concentric cam. The latch is thereby adapted to receive the bar 200. Preferably the tip 228 of the hook extends beyond the body of the latch. This design facilitates the grasping and interlocking of bar 200 of receiver 11. Preferably the latches 220 are positioned such that the arcuate recess 225 is open to (i.e., faces) the bar 200 of receiver 11 when in the unattached position. Each latch 220 includes a lower sloped portion 227 that serves to guide bar 200 into the arcuate recess 225, and an opposite hook 228 that helps engage the bar 200 once guided into arcuate recess 225.

This positioning of latches 220 relative to bar 200 allows for the automatic or semi-automatic mounting of the frame 10 to the vehicle. Once the height of the frame 10 relative to the bar 200 is appropriately positioned (which is preferably accomplished by proper movement of the jack as discussed above), the vehicle to which the receiver 11 is attached is simply driven towards the frame 10 until the latches 220 engage the bar 200. Due to the configuration of the slope portion 227, hook portion 228 and arcuate recess 225, the force of the bar 200 engaging the latches 220 cause the latches 220 to rotate counter-clockwise and lock the bar 200 in place. Suitable locking pins (not shown) or other safety locking mechanism can be used to ensure that the frame 10 does not prematurely disengage from the vehicle. One suitable locking assembly includes a spring loaded pin assembly, with spring biasing against the pin. In the locked position, the spring forces the pin through an appropriately dimensioned aperture in side gusset 54, thereby fixing the latch 220 in place. A lever prevents the pin from retracting out of the aperture in the gusset 54. In the unlocked position, the pin is retracted from the aperture, allowing movement of the latch for engagement or disengagement of the hitch. Each latch 200 can have a safety lock, or preferably a single safety lock can be used, preferably in conjunction with the latch that is located on the same side of the apparatus as lever 221, for operator convenience.

Those skilled in the art will appreciate that the latches 220 (i.e., the engaging means) could be located on the receiver 11, and the bar 200 (i.e., the engaged means) on the assembly 10. Thus, the receiver 11 and the assembly 10 cooperate to create a releasable coupling of the two.

Figure 2:
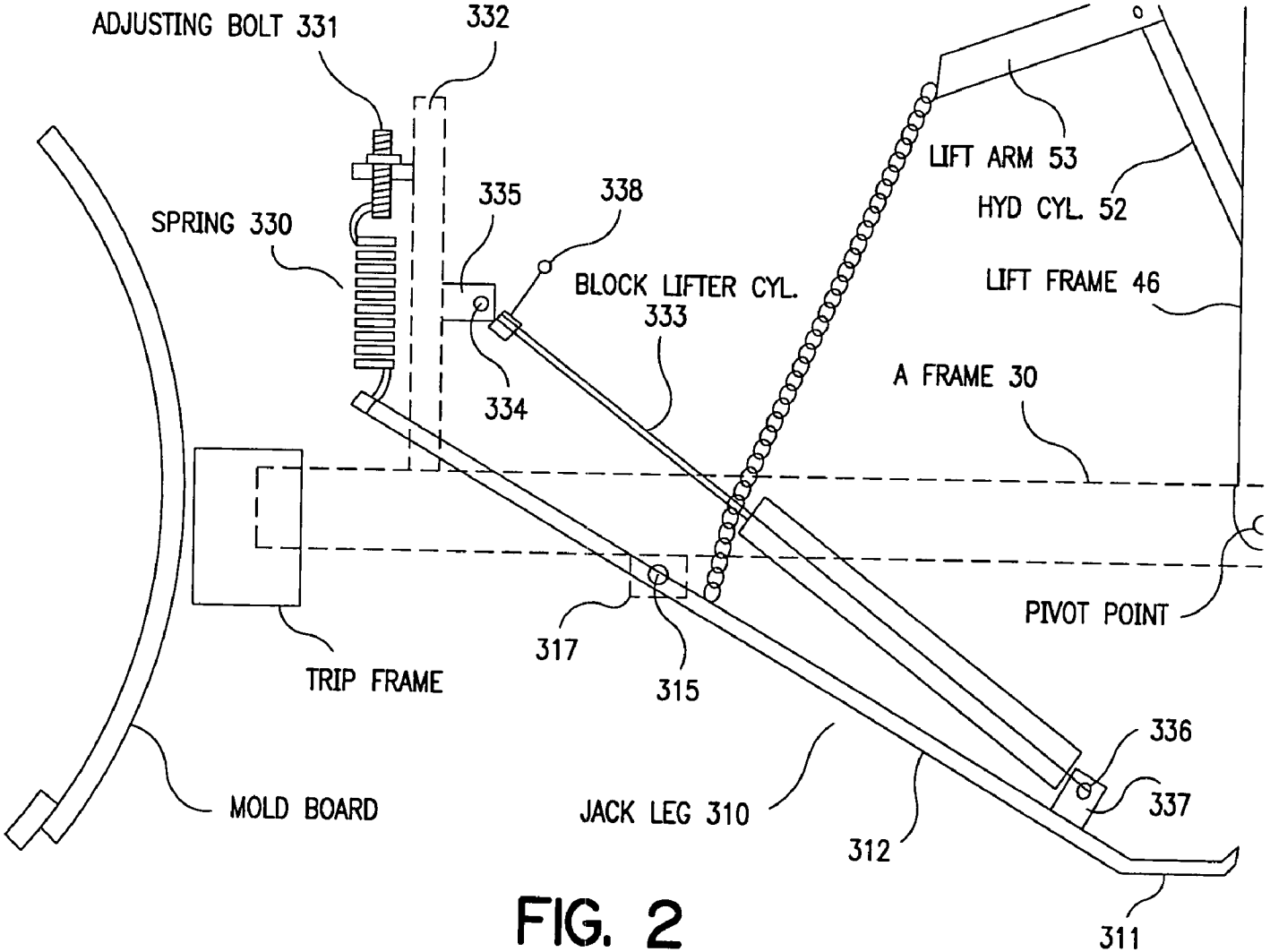
FIG. 2 is a side view of one embodiment of the jack assembly in accordance with the present invention.

Turning now to FIG. 2, one embodiment of the jack assembly of the present invention is shown. The jack uses no outside dedicated power in order to function; it has its own independent power source. The jack leg 310 preferably consists of 2 parts; a skid shoe 311 for contacting the ground (or other substrate) and a relatively straight elongated portion 312. Side gussets 337 (one shown) are connected to jack 310 such as by welding. Preferably the chain or other linkage 110 is connected to the jack leg 310 in an area between the fulcrum point and the skid shoe 311. Linkage or other means (such as a moment arm) can be used if the chain 110 is connected before the fulcrum point.

The jack leg 310 is pivotally connected to the A-frame assembly 30 via pin 315 through opposite side gussets 317 (one shown). Additionally, the jack leg is connected to spring 330, which in turn is connected via an adjusting bolt 331, to vertical bracket 332. This vertical bracket is attached to the A-frame such as by welding. Side gussets 335 (one shown) are connected to the vertical bracket as by welding. A block lifter cylinder 333 is pivotally attached to bracket 332 via pin 334 through opposite side gussets 335 and to the jack 310 via pin 336 through opposite side gussets 337. The block lifter cylinder 333 includes an actuator/release lever 338. Release of this lever causes the cylinder to expand up to its fully deployed state. The block lifter cylinder can be compressed, as by lifting the chain 110, without release of the lever 338. However, the cylinder cannot be expanded without release of the lever 338.

When hydraulic cylinder 52 is actuated such as by a switch in the driver's vehicle, the cylinder 52 expands causing pivot hood 53 to correspondingly lift, drawing chain 110 (or other suitable linkage) in a vertical direction relative to the substrate. As the chain 110 lifts, it draws jack leg 310 upward until the jack comes into contact with A-frame assembly 30. As the jack is drawn up, block lifter cylinder 333 compresses and spring 330 expands. This creates a state where both have stored energy, which can be used at a later time when the jack is to be deployed. As the vertical actuation of the chain 110 continues, the entire A-frame assembly begins to lift as a result of the contact between it and the jack. Those skilled in the art will appreciate that while the A-frame is in the lifted position, it is not possible for the jack to be in the down or deployed position, since tension from chain 110 will insure that the jack remains lifted. This built-in safety feature insures that the jack is never unknowingly put in the down or deployed position while the A-frame is in a raised position, which typically occurs when the vehicle is being driven.

To deploy the jack, hydraulic cylinder 52 is actuated as by a switch in the driver's vehicle. The cylinder 52 compresses (but preferably not completely), causing pivot hood 53 to correspondibly descend toward the A-frame assembly 30, thereby allowing the assembly 30 to lower toward the ground. When the A-frame has reached its lowered position, the pivot hood continues to descend, releasing the tension on chain 110. However, the jack 310 remains in the raised position, since lever 338 has not been released. In this position, the assembly is ready for operation, such as plowing where the utilitarian accessory is a snow plow blade.

Once lever 338 is released, preferably manually (as by the vehicle's driver), the spring 330 is allowed to compress, the block lifter cylinder is allowed to expand, moving jack leg 310 toward the substrate, and cylinder 52 compresses beyond its earlier compression amount. The energy stored in the spring 330 and the block lifter cylinder 333 then allows the jack leg 310 to engage the substrate and lift the A-frame assembly 30 to the desired height in order to attach and detached the assembly 10 from the vehicle, or to attach or detach the snow plow blade or other utilitarian accessory to the assembly.

The required tension for spring 330 can be manually adjusted such as with adjusting bolt 331 to compensate for spring aging, temperature variations, etc. Tightening of the adjustment bolt will increase its compression force, allowing it to sufficiently raise the lift assembly.

Figure 3:
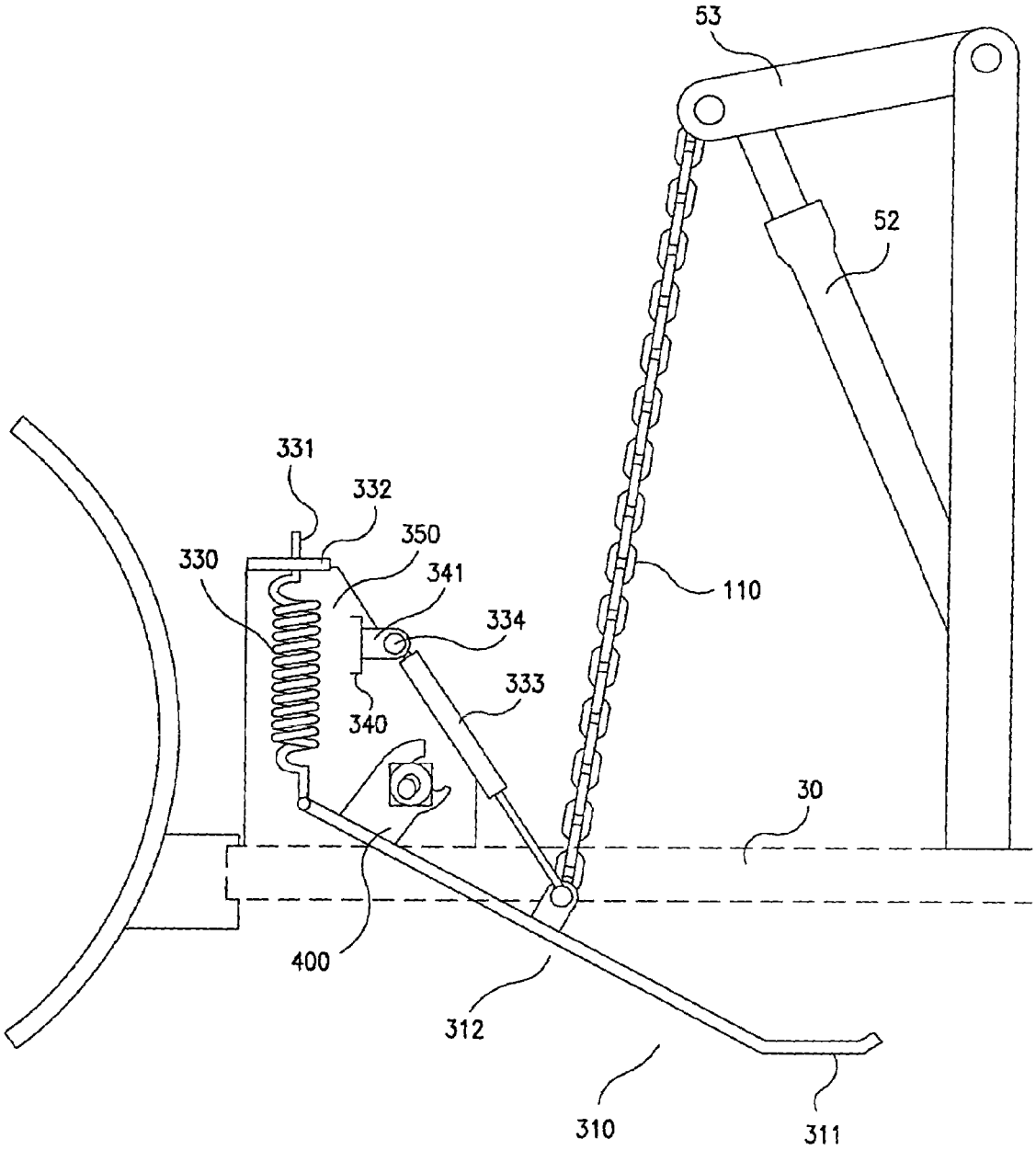
FIG. 3 is a side view of a second embodiment of the jack assembly in accordance with the present invention.

FIG. 3 illustrates a second embodiment of the invention. The jack leg 310 preferably consists of 2 parts; a skid shoe 311 for contacting the ground (or other substrate) and a relatively straight elongated portion 312. Preferably the chain or other linkage 110 is connected to the jack leg 310 in an area between the fulcrum point and the skid shoe 311. Linkage or other means (such as a moment arm) can be used if the chain 110 is connected before the fulcrum point. Locking tab 400 is connected to jack 310 such as by welding.

The jack leg 310 is pivotally connected to the A-frame assembly 30 via jack pivot rod 315 through opposite side gussets 317 (one shown). Additionally, the jack leg is connected to spring 330, which in turn is connected via an adjusting bolt 331, to horizontal bracket 332. This horizontal bracket is attached to a metal shroud 350 such as by welding. Side gusset 341 is connected to the vertical bracket 340 such as by welding. A block lifter cylinder 333 is pivotally attached to bracket 340 via pin 334 through side gusset 341 and to the jack 310 via pin 315 through side gusset 317. Bracket 340 is connected to a metal shroud 350 such as by welding.

Figure 4:
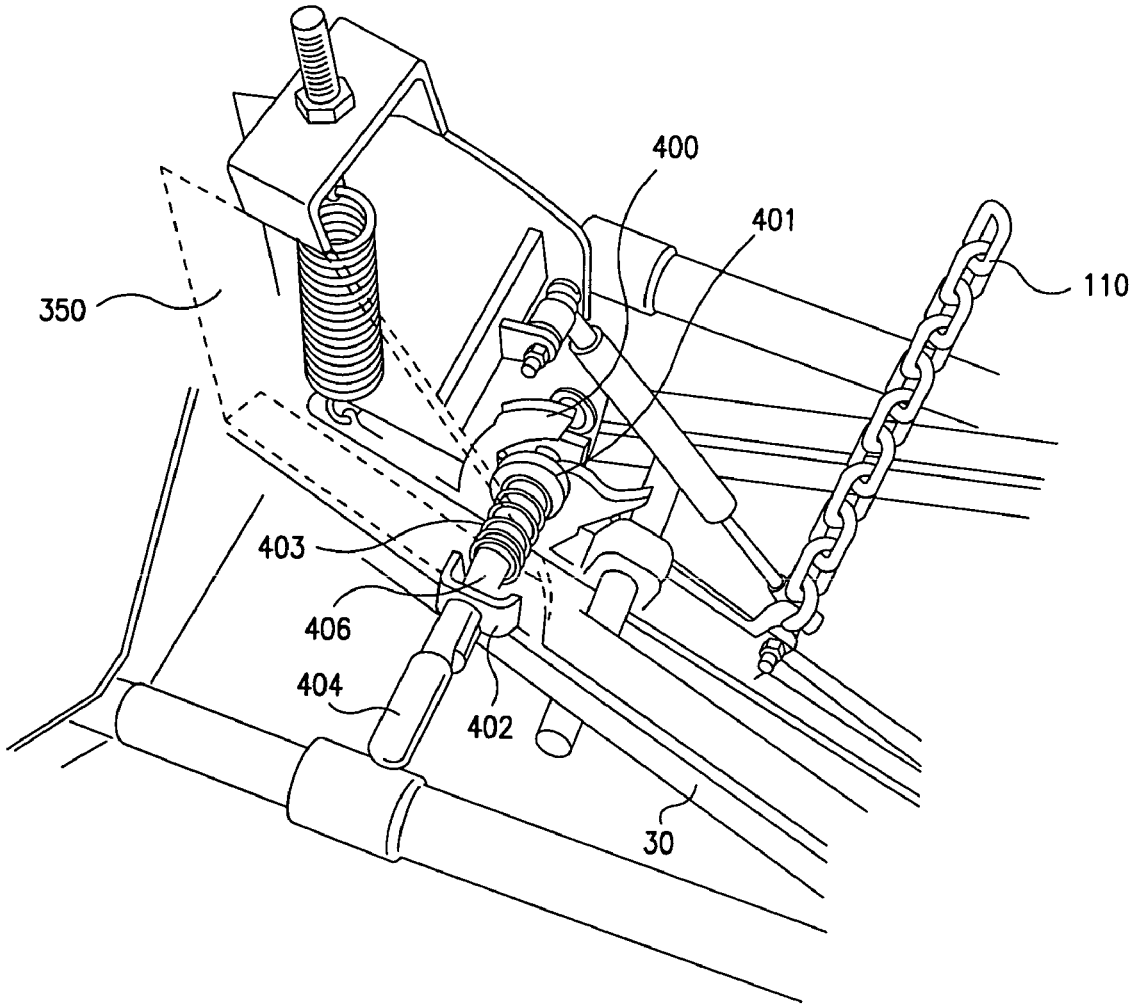
FIG. 4 is an expanded view of the second embodiment with the jack in the deployed position.

Referring to FIG. 4, an expanded view of the locking mechanism is shown, with the jack in its deployed position. Friction brake 401 is connected to brake rod 406 such as by welding. The brake rod is connected to metal shroud 350 via side gussets 402 (one shown). A brake spring 403 biases the friction brake toward its deployed position, where it is pressed against locking tab 400. A brake release handle 404 is connected to the brake rod 406, such as by pivot. Rotating the release handle toward the frame 30 draws the brake rod through gusset 402. This action causes the friction brake to disengage from the locking tab 400, thereby allowing free motion of the jack.

Figure 5:
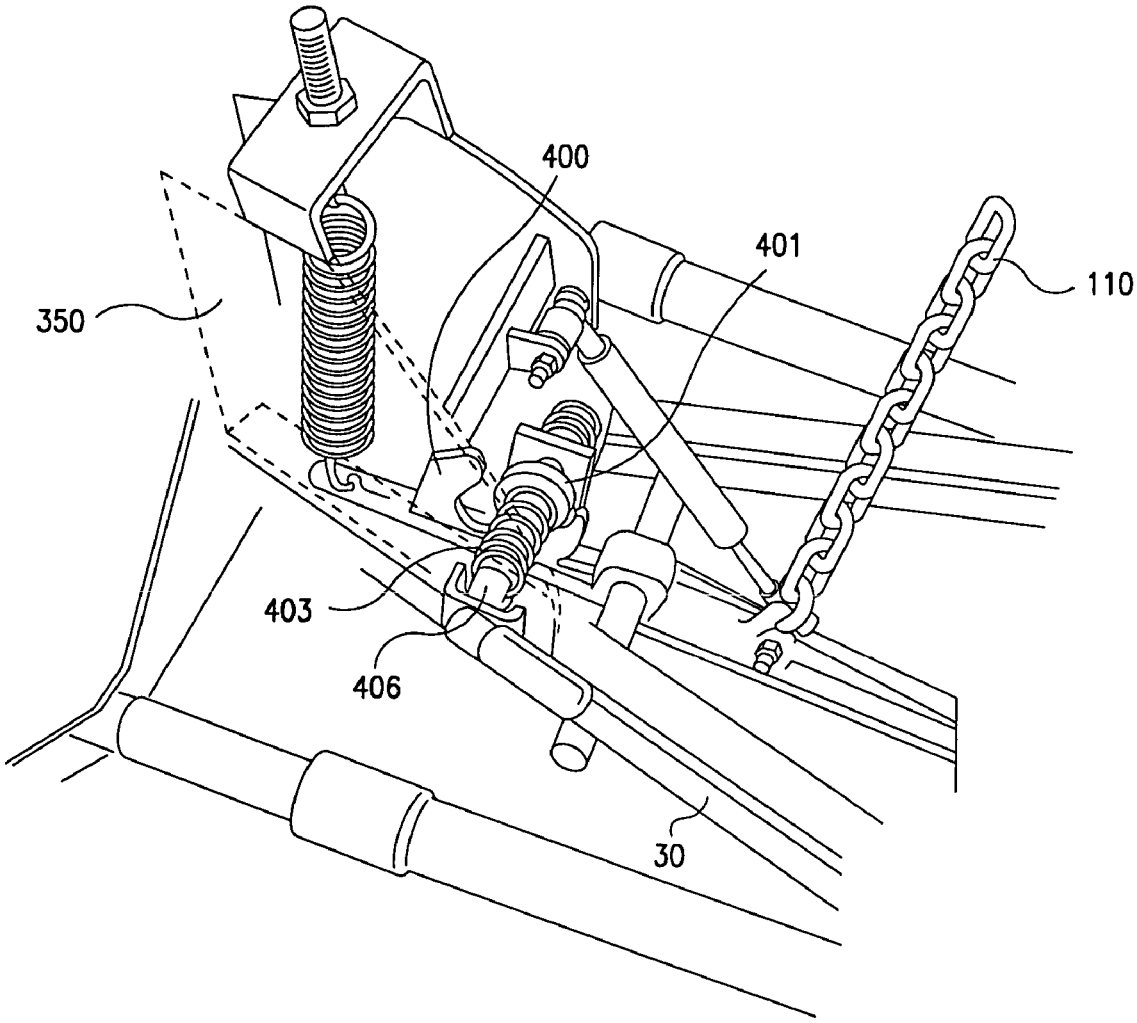
FIG. 5 is an expanded view of the second embodiment with the jack in the inoperative position.

Referring to FIG. 5, an expanded view of the locking mechanism is shown, with the jack in its inoperative position. When the jack is raised, the notch in the locking tab 400 aligns with the friction brake 401. Brake spring 403 presses the friction brake into the notched area until it reaches brake stop 405. This effectively locks the jack in this position, as the jack with its locking tab cannot be moved until the friction brake is released. The friction brake is released by rotating the brake release lever 404 toward the frame 30. This rotation draws the brake rod through the gusset 402 and the friction brake away from the brake stop and locks the brake in its inoperative position until the brake release lever is again rotated to be in line with the brake rod.

Referring to FIG. 3, when hydraulic cylinder 52 is actuated as by a switch in the driver's vehicle, the cylinder expands causing pivot hood 53 to correspondingly lift, drawing chain 110 (or other suitable linking means) in a vertical direction relative to the substrate. As the chain 110 lifts, it draws jack leg 310 upward until it comes into contact with A-frame assembly 30. As the jack is drawn up, block lifter cylinder 333 compresses and spring 330 expands (alternatively, a compression spring could be located at the other side of the fulcrum point in place of spring 330). This creates a state where both have stored energy, which can be used at a later time when the jack is to be deployed. The horizontal position of the jack causes locking tab 400 to rotate relative to the friction brake. In this rotated position, the notch inherent in the locking tab aligns with the friction brake 401. The friction brake, which is biased toward this notch by the brake spring 403, moves into this notched area, thereby locking the jack in the inoperative position. As the vertical actuation of the chain 110 continues, the entire A-frame assembly begins to lift as a result of the contact between it and the jack leg 310. Those skilled in the art will appreciate that while the A-frame is in the lifted position, it is not possible for jack 310 to be in the down position, since tension from chain 110 will insure that the jack remains lifted. This built-in safety feature again insures that the jack is never unknowingly put in the down or deployed position while the A-frame is in a raised position, which typically occurs when the vehicle is being driven.

To deploy the jack, hydraulic cylinder 52 is actuated as by a switch in the driver's vehicle. The cylinder 52 compresses (but not completely), causing pivot hood 53 to correspondingly descend toward the A-frame assembly 30, thereby allowing the lift assembly 30 to lower toward the ground. When the A-frame has reached its lowered position, the pivot hood continues to descend, releasing the tension on chain 110. However, the jack 310 remains in the raised position, since friction brake 401 is still engaged in the locked position. In this position, the assembly is ready for operation, such as plowing where the utilitarian accessory is a snow plow blade.

When brake release handle 404 is deployed, the friction brake 401 moves away from the locking tab 400, thereby releasing the jack leg to descend toward the ground, using the stored energy from both the spring 330 and the block lifter cylinder 333. The brake spring 402 continues to bias the friction brake toward the jack leg, thereby providing resistance. This resistance is sufficient to prevent the jack leg from moving after it has engaged with the substrate. This allows the assembly to be detached, as from a truck, and to retain the correct height so as to remain aligned with the truck.

Figure 6:
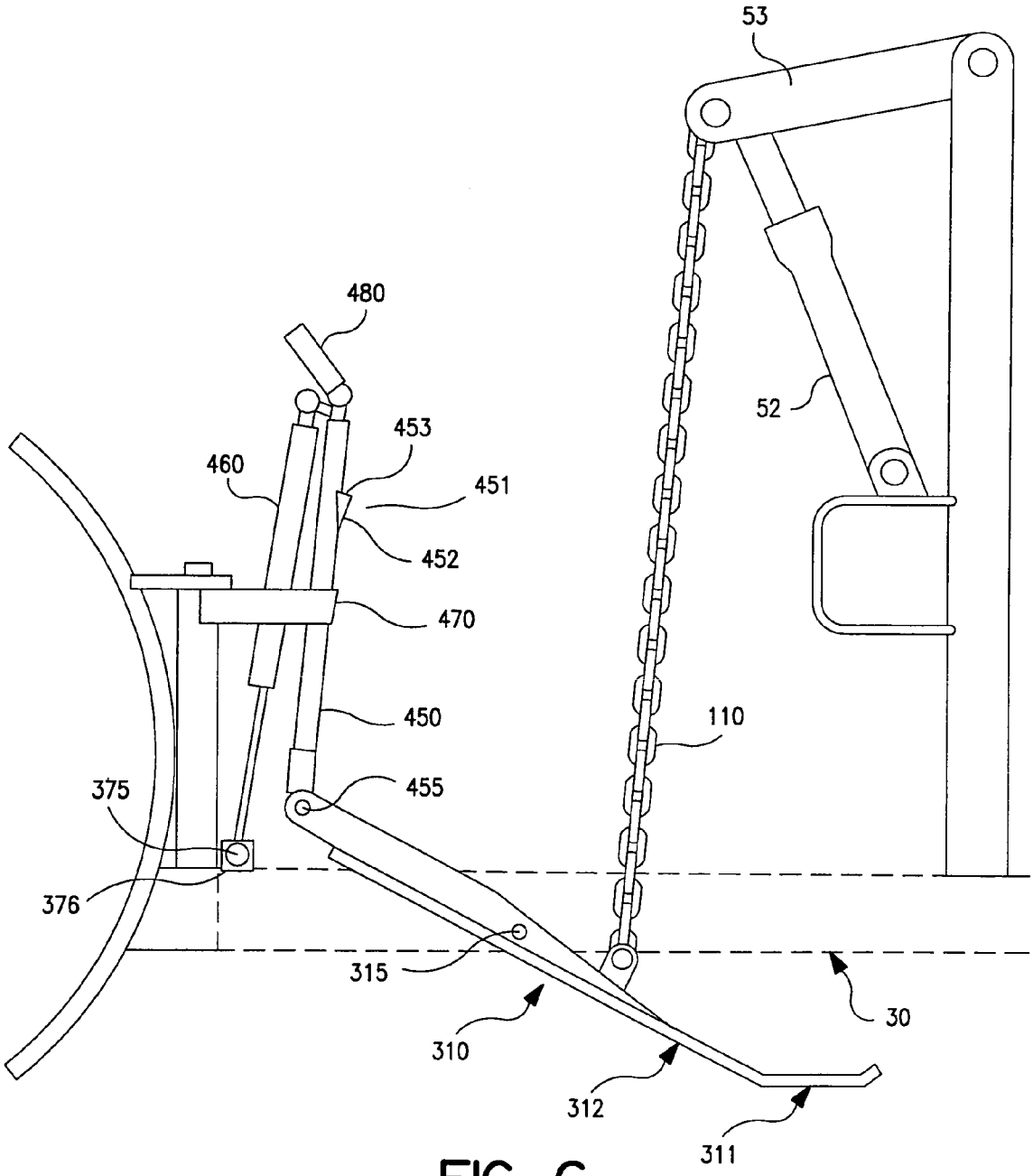
FIG. 6 is a side view of a third embodiment of the jack assembly in accordance with the present invention, with the jack in the deployed position.

In FIG. 6, a third embodiment of the invention is shown. The jack leg 310 preferably consists of 2 parts; a skid shoe 311 for contacting the ground (or other substrate) and a relatively straight elongated portion 312. Preferably the chain or other linkage 110 is connected to the jack leg 310 in an area between the fulcrum point and the skid shoe 311. Linkage or other means (such as a moment arm) can be used if the chain 110 is connected before the fulcrum point. The jack leg 310 is pivotally connected to the A-frame assembly 30 via jack pivot rod 315. Jack rod 450 is rigid, preferably made of steel tubing, and at one end is pivotally connected to jack 310 via pivot rod 455. Jack rod 450 has a protrusion 451, appropriately positioned along the length of the rod 450, which comprises a sloped side portion 452, and a relatively straight top portion 453. The jack rod 450 is coupled to the gas cylinder 460 at or near it's opposite end, such as by welding. Jack release handle 480 is connected to the junction of jack rod 450 and gas cylinder 460 such as by welding. The opposite end of the gas cylinder is pivotally attached to the A-frame assembly 30 (or trip frame) via cylinder pivot rod 375 through side gusset 376. Holding bracket 470 is connected to the A-frame 30 as by welding. Both the jack rod 450 and the gas cylinder 460 travel inside holding bracket 470.

When hydraulic cylinder 52 is actuated as by a switch in the driver's vehicle, the cylinder expands (but not completely) causing pivot hood 53 to correspondingly lift, drawing chain 110 (or other suitable linking means) in a vertical direction relative to the substrate. As chain 110 is lifted, it draws jack leg 310 upward toward A-frame 30. This movement causes the jack leg on the opposite side of the jack pivot rod 315 to move downward. This downward motion draws the jack rod 450 downward, which compresses the gas spring 460. This creates stored energy within the gas spring. Since the protrusion 451 has a sloped portion 452 that faces in this direction, it is able to slide past the holding bracket 470 during this movement.

Figure 7:
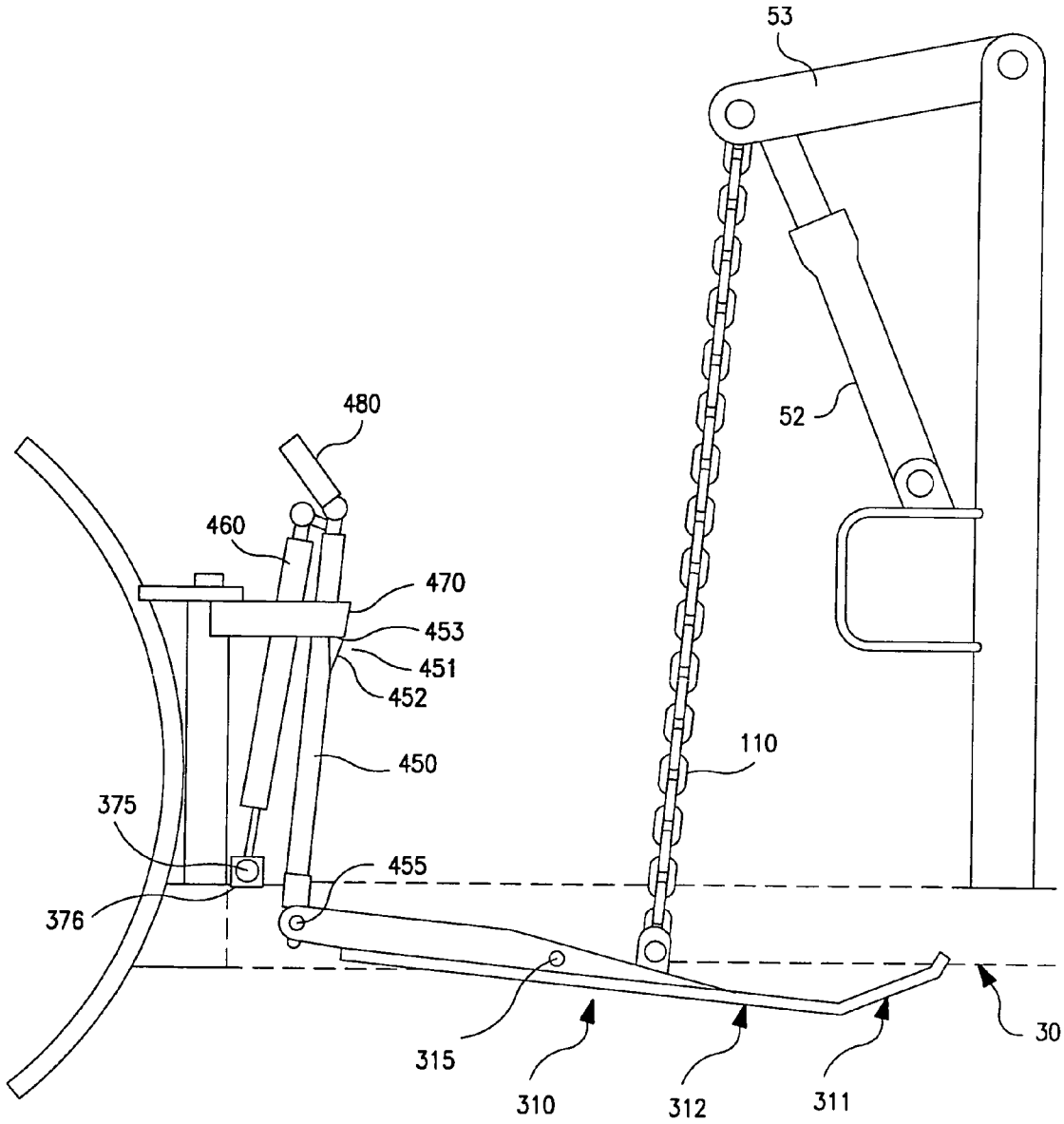
FIG. 7 is a side view of the third embodiment with the jack in the inoperative position.

FIG. 7 shows the third embodiment of the invention with the jack in the inoperative position. Once the jack leg has been completely lifted, protrusion 451 is appropriately positioned along the length of the rod 450 so that it is located beneath the holding bracket 470. Relatively straight top portion 453 engages with the holding bracket 470, locking the rod 450 and therefore the jack leg in place, since the stored energy inside the gas spring 460 is biasing the protrusion on the jack rod against the holding bracket 470. The protrusion 451 thus provides a stop against further upward movement of the rod 450.

To deploy the jack, hydraulic cylinder 52 is actuated as by a switch in the driver's vehicle. The cylinder 52 compresses (but not completely), causing pivot hood 53 to correspondingly descend toward the A-frame assembly 30, thereby allowing the assembly 30 to lower toward the ground. When the A-frame has reached its lowered position, the pivot hood continues to descend, releasing the tension on chain 110. When the assembly has been lowered, and tension on the chain removed, the jack release handle 480 can be actuated. Deploying the jack release handle 480 moves the jack rod toward the plow blade and away from the holding bracket 470, allowing the protrusion 451 to move out of the path of the holding bracket (defeating its function as a stop) and move upward. The stored energy inside the gas spring pushes the jack rod upward, which forces the jack skid shoe 311 downward toward the substrate. This stored energy in the gas spring 460 maintains the jack in its deployed state.

Figure 8:
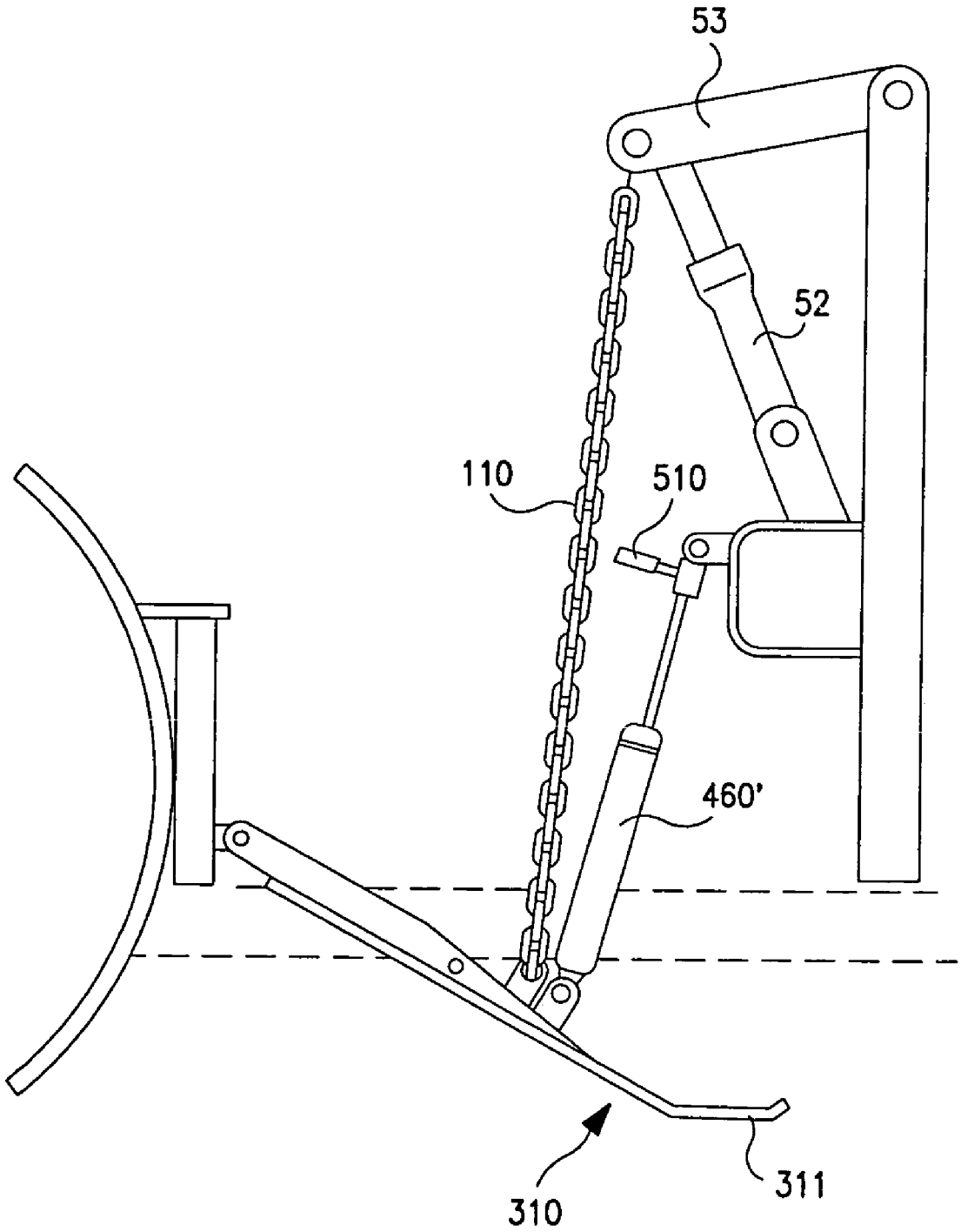
FIG. 8 is a side view of a fourth embodiment of a jack in accordance with the present invention.

FIG. 8 illustrates yet another embodiment, similar to a blocker lift, wherein both one end of gas spring 460' and linkage 110 are connected to the jack leg 310 in an area between the fulcrum point and the skid shoe 311. The gas spring 460' includes lever 510, the actuation of which causes the gas spring to expand and deploy, thereby deploying the jack. Actuating the hydraulic cylinder 52 raises the linkage 110 with sufficient force to overcome the counter-force being applied by the gas spring 460', thereby causing the gas spring 460' to compress and lifting the jack to its stored position as in the previous embodiments.

Figure 9:
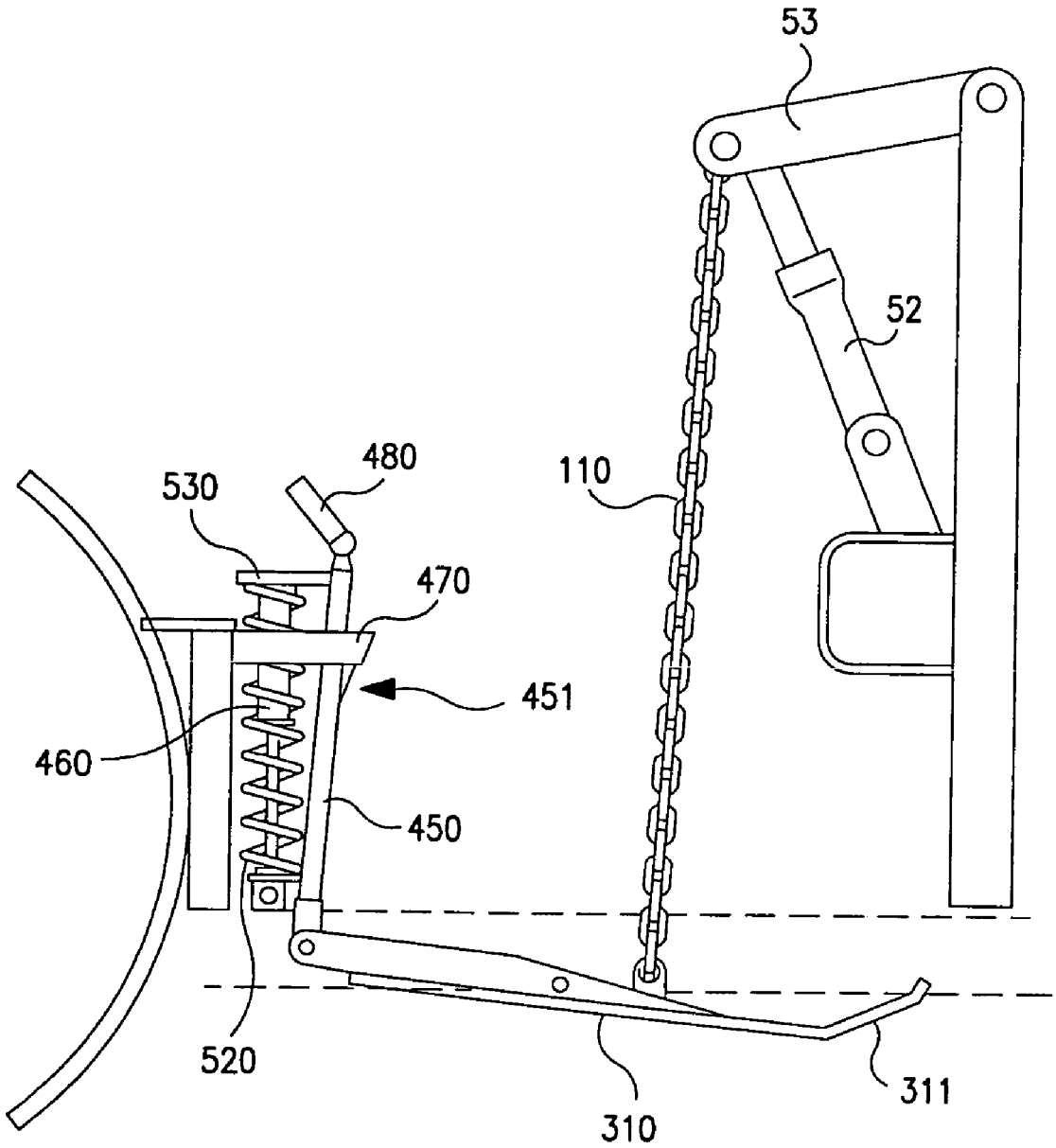
FIG. 9 is a side view of a fifth embodiment of a jack in accordance with the present invention.

FIG. 9 illustrates an embodiment similar to that of FIGS. 6 and 7, except that a coil spring 520 surrounds gas spring 460 to add spring rate to the assembly. Top plate 530 is coupled to the rod 450 and is threaded in order to adjust the tension of the spring 520.

What is claimed is:

1. A jack for raising and lowering a working implement relative to a substrate, comprising:

a jack having a substrate engaging end and a portion spaced therefrom for coupling said jack to said assembly;

a first actuator, actuation of which moves said jack from a deployed position in which said substrate engaging end contacts said substrate to an inoperative position in which said substrate engaging end is not in contact with said substrate;

a second actuator, actuation of which moves said jack from said inoperative position to said deployed position, whereby the range of motion between said inoperative position and said deployed position is infinitely adjustable;

wherein actuation of said first actuator creates stored energy in said second actuator.

2. The jack of claim 1, wherein said first actuator comprises a chain dedicated to the lifting of said assembly.

3. The jack of claim 2, further comprising a frame, and wherein said chain is fixed to said jack such that upon actuation of said chain, said jack moves to said inoperative position and contacts said frame, causing said frame to move in the same direction of the jack.

4. The jack of claim 1, wherein said stored energy in said second actuator is utilized upon actuation of said second actuator and causes said jack to move from said inoperative position to said deployed position.

5. The jack of claim 4, wherein said second actuator is selected from the group comprising a gas spring, a hydraulic cylinder, a mechanical spring, and combinations thereof.

6. The jack of claim 1, wherein said second actuator comprises a rigid rod having a first end coupled to said jack and a second end coupled to a gas spring.

7. The jack of claim 6, wherein said rigid rod travels in a path between said deployed position and said inoperative position, and wherein said rigid rod further comprises a stop for the movement of said rod in said path in order to maintain said rod in said inoperative position.

8. The jack of claim 1, wherein said first actuator moves said jack to a substantially horizontal position relative to said substrate when in said inoperative position.

9. A jack for raising and lowering a working implement relative to a substrate, comprising:

a jack having a substrate engaging end and a portion spaced therefrom for coupling said jack to said assembly;

a first actuator for moving said jack from a deployed position in which said substrate engaging end contacts said substrate to an inoperative position in which said substrate engaging end is not in contact with said substrate;

a second actuator for moving said jack from said inoperative position to said deployed position, whereby the range of motion between said inoperative position and said deployed position is infinitely adjustable, wherein said first actuator comprises a chain dedicated to the lifting of said assembly.

10. The jack of claim 9, further comprising a frame, and wherein said chain is fixed to said jack such that upon actuation of said chain, said jack moves to said inoperative position and contacts said frame, causing said frame to move in the same direction of the jack.

* * * * *